United States Patent [19]

Allwin

[11] Patent Number: 4,848,462

[45] Date of Patent: Jul. 18, 1989

[54] ROTATABLE LINER HANGER

[75] Inventor: Roger P. Allwin, College Station, Tex.

[73] Assignee: Lindsey Completion Systems, Inc., Midland, Tex.

[21] Appl. No.: 191,387

[22] Filed: May 9, 1988

[51] Int. Cl.[4] ..... E21B 23/00; E21B 43/10

[52] U.S. Cl. ..... 166/208; 166/212; 166/217

[58] Field of Search ..... 166/208, 215, 217, 123, 166/216, 212, 124

[56] References Cited

U.S. PATENT DOCUMENTS

| | | | |
|---|---|---|---|
| 3,012,612 | 12/1961 | Wright et al. | 166/208 |
| 3,285,345 | 11/1966 | Solum | 166/208 |
| 3,463,229 | 8/1969 | Hinkle | 166/215 |
| 4,688,642 | 8/1987 | Baker | 166/217 |
| 4,712,614 | 12/1987 | Allwin et al. | 166/208 |
| 4,712,615 | 12/1987 | Dockins, Jr. et al. | 166/208 |
| 4,762,177 | 8/1988 | Smith, Jr. | 166/217 |

*Primary Examiner*—Jerome W. Massie, IV
*Assistant Examiner*—Terry L. Melius

[57] ABSTRACT

A rotatable liner hanger for an oil well with a supporting mandrel having an annular recess with upper and lower shoulders and a tubular housing and a bearing means disposed in the recess. The housing has elongated windows with side surfaces having tongue and grooves at an inclination angle of 15° and elongated slip members with interfitting tongue and grooves along their side surfaces where the slip members are initially retracted within the windows of the housing and are extendible outwardly into load bearing support with a casing. A selectively actuated device controls the positioning of the slip members and an annular recess in the housing provides a bypass area when the slip members are extended.

4 Claims, 2 Drawing Sheets

ROTATABLE LINER HANGER

FIELD OF THE INVENTION

This invention relates to liner hangers for use in hanging liners in a well bore, and more particularly, to hydraulically set liner hangers where the slip configuration in a liner hanger permits a reduction in effective radial loads or radial hoop stresses to the casing and to the support for the slips and where the liner hanger mandrel is rotatably mounted relative to the liner hanger slips.

BACKGROUND OF THE PRESENT INVENTION

A liner hanger for use in hanging liners in a well bore typically involves an inclined and annular slip expander surface with an inclination at an angle of 5 to 7 degrees relative to a lengthwise axis and complimentarily inclined and circumferentially spaced wall engaging slips slidably mounted on the expander. In some instances the expander is only circumferentially spaced inclined surfaces rather than a continuous annular surface. Use of circumferentially spaced expander surfaces enhances the fluid bypass about the surfaces.

The slips in a liner hanger are initially releasably retained in a longitudinal, spaced apart position from the expander surfaces until the liner hanger is in a location in a well bore or casing where the slips are intended to be set. The liner hanger is typically attached to the upper end of a string of pipe joints called a "liner" and the liner hanger, in turn, is releasably coupled to a setting tool. The setting tool, in turn, is connected to a length of drill pipe which is made up, section by section, to the earth's surface. The liner has an O.D. (outer diameter) as large as possible to pass through the I.D. (inner diameter) of any pipe already cemented or located in a borehole or any borehole located below a pipe in the well bore. This means that the annular space between the O.D. of a liner and I.D. of a borehole or pipe already in a well bore is kept as small as possible. At the lower end of the liner is float equipment which provides cementing back pressure valves.

Because of the annulus between the liner and a borehole or pipe has a small clearance, any obstruction in the annulus clearance or reduction of the effective open area in the annulus causes resistance to downward movement of the liner and liner hanger while it is lowered into the well bore through the mud in the well bore. This slows down the operation of moving the liner and liner hanger to the desired location. One of the critical areas of blockage in the annulus between a liner hanger and a well casing or well pipe is the slip and expander construction which projects outwardly of the overall diameter dimension of the liner hanger when it is set and restricts the annular fluid flow during the cementing operation.

As noted above, the slips are initially in a retracted condition relative to an expander surface. At the location in a well bore where the liner hanger is hung, the slip members are released and moved relative to the expander surface and by virtue of engagement the inclined expander surface with the inclined surface of a slip, the slips will move outwardly into engagement with the wall of a well bore and "hang" or support the weight of the liner. The weight of the liner is transmitted through the slip to the contact surface with the expander surface and develops a radial force on the slips and the expander surface. The radial force on the expander is equal and opposite to the radial force of the slips to the casing and is inversely proportional to the slip angle. Heavy liner loads can actually radially punch or distort the casing or can collapse an expander. One of the problems, where it is desired to rotate a mandrel on which an expander is rotatably mounted, is that radial contraction of the expander "seizes" or frictionally grips the mandrel so that rotation of the mandrel relative to the expander is not possible.

The expander and slip angle of inclination is maximized at usually from 5 to 7 degrees to minimize the radial forces on the expander and on the casing and also to keep the contact surface between a slipp and expander surface as large as possible so as to minimize the contact pressure (PSI). As noted, the angle of inclination affects the effective surface area between an expander and slip in load supporting contact. Effective fluid bypass for fluid around the slip and expander construction is affected by the circumferential size of the slips projecting outwardly of the expanders. Thus, for supporting purposes, the maximum slip area possible is achieved by a full-circle (360°) of slips. But this combination results in no annular area for fluid bypass. It is therefore apparent that current slips designs are limited in their ability to minimize contact pressure due to the interrelationship of slip angle and the slip area and the direct effect that an increase in the bypass area will proportionately decrease the slip area.

Heretofore, as disclosed in U.S. Pat. No. 4,712,615, issued Dec. 15, 1987 and assigned to the assignee of the present invention, a slip and expander arrangement is illustrated wherein an elongated vertical "window" in a liner mandrel and an interfitted slip in a window are provided with inclined tongue and groove interconnections along the length of a slip member and a liner "window". The inclinations can be much greater than conventional slip and expanders and can be 15 degrees relative to a longitudinal axis. This structure results in radial forces two to three times lower than 5° and 7° slips. Additionally the weight load of a liner can be distributed along an unlimited vertical length of the outer surface of a slip since the slip length is not determined by the slip angle. This provides greater contact surface for reducing radial load on a casing without the need to decrease annular fluid bypass area.

As a result, slip contact pressures can now be held to a minimum with no negative effect on bypass.

THE PRESENT INVENTION

The present invention is embodied in a hydraulically actuated rotatable liner hanger where a rotatable liner hanger mandrel provides a flow passageway through the liner hanger which is effectively the same I.D. as a depending attached liner. At the upper end of the liner hanger is a bearing means and a tubular housing which are rotatively mounted relative to the liner hanger mandrel but are not longitudinally movable relative to the liner hanger mandrel. Circumferentially spaced about the expander housing are vertically or lengthwise extending, elongated expander windows each having regularly spaced inclined slots along the sides of a window where the inclined slots are preferably inclined at 15° relative to a vertical or lengthwise axis. Elongated slip members each have regularly spaced, inclined slots along the sides of a slip member where the slots are preferably inclined at 15° relative to a vertical or lengthwise axis. The slip members are slidably received in the expander housing windows and arranged to slidably move from an unset condition of retraction with respect to the expander housing to set condition of extension with respect to the expander housing. When the slip members are in a condition of extension, the slip members are engagable with the bore of a casing and the support of the slip members along the length of the expander housing window is distributed along the side edge tongue and groove interconnections of the slots in a window and in a slip member. Preferably, Three circumferentially spaced slip members are employed and substantially reduce the radial hoop loading on the tubular housing so that it will not "seize" the rotatable mandrel. In addition, the construction allows for maximum fluid bypass that is equal to the annular restriction at the bearing above the slips.

DESCRIPTION OF THE INVENTION

Figure 1:
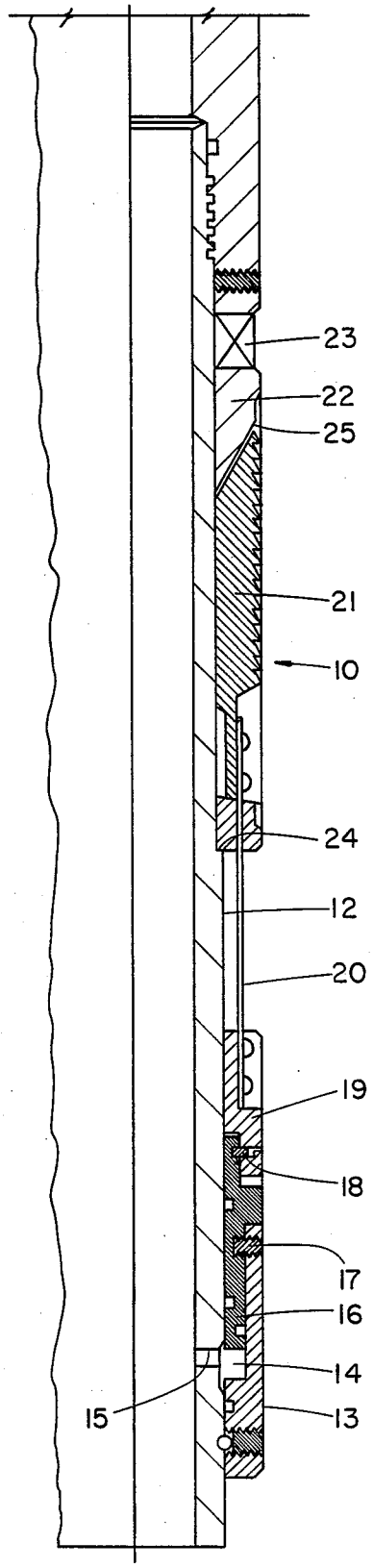
FIG. 1 is a partial view in cross-section through a hydraulically set liner hanger.

A rotatable liner hanger and a liner are schematically illustrated in FIG. 1. The rotatable liner hanger 10 includes a central rotatable tubular mandrel 12 which is connected at its lower end to a liner (a string of pipe joints coupled to one another and not shown). The upper end of the rotatable mandrel 12 is releasably connected to a setting tool and drill pipe (not shown) when run in a well bore. The liner hanger 10 as illustrated in FIG. 1 is a hydraulically set liner. That is, the rotatable mandrel 12 has an attached cylindrical housing 13 which has an annular hydraulic chamber 14 opening to the bore of the mandrel 12 by a port 15. A piston member 16 is connected in a lower position in the chamber by a shear pin 17. The piston member 16 is connected by a shear pin 18 to an annular slip strap ring 19. Lengthwise extending straps 20 couple the strap ring 19 to the respective slip elements 21.

In the present invention, the rotating mandrel 12 is an essentially integral tubular pipe member. That is, the bore of the mandrel 12 is continuous and can be pressure sealed at connecting couplings so as to contain pressure. Thus, the rotating mandrel 12 is particularly adaptable to hydraulically operated setting tools or other operations where it is necessary to contain hydraulic pressure in the pipe member. A tubular housing member 22 is rotatively mounted on the mandrel 12 between the downwardly facing surface of a bearing means 23 and an upwardly facing shoulder 24 on the mandrel 12. The housing member 22 has at least three circumferentially spaced longitudinally extending, expander slots or expander windows 25 which have tongue and groove expander surfaces disposed along the side edges of an expander window. Slip members 21 are slidably received in the expander slots and have their lower ends attached to elongated strap members 20 which attach to the strap ring 19.

Figure 2:
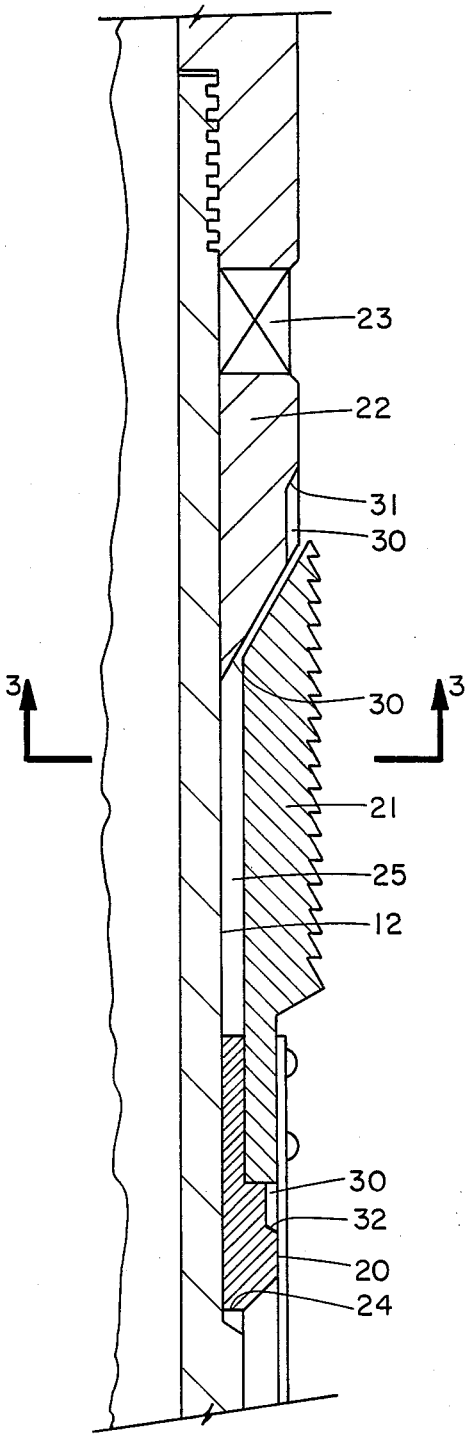
FIG. 2 is an enlarged view in partial cross-section of a slip and expander construction according to the present invention.
Figure 5:
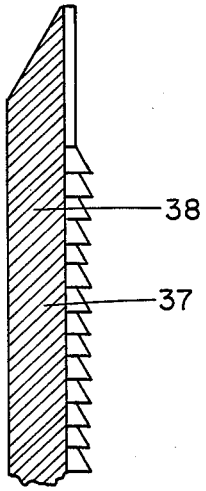
FIG. 5 is a partial view in longitudinal cross-section through a slip member.
Figure 6:
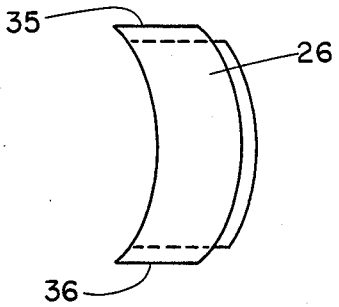
FIG. 6 is an end view of a slip member.

A more detailed illustration of the slip and expander construction is shown in FIGS. 2–6. As illustrated in FIG. 2, an elongated lengthwise extending slip slot or window 25 has an upper inclined surface 30 at one end. Along each of the parallel sides 31 and 32 (see FIG. 4) of a slip slot 25 are inclined tongue and grooves 33, 34 which are inclined at an angle of 15 degrees with respect to a lengthwise extending axis or longitudinal direction. Each slip 21, as shown in FIGS. 5 and 6, has parallel side surfaces 35, 36 with inclined tongue and grooves 37, 38 which are inclined so as to be slidably received in the inclined tongue and grooves 33, 34 of a slip slot 25. Thus, a slip 21 is keyed by a tongue and groove arrangement on each longitudinal side of a slot 25.

Figure 3:
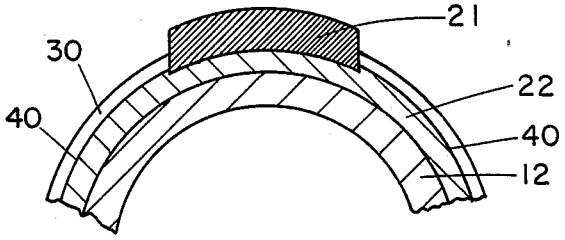
FIG. 3 is a partial view in cross-section taken along line 3—3 of FIG. 2.
Figure 4:
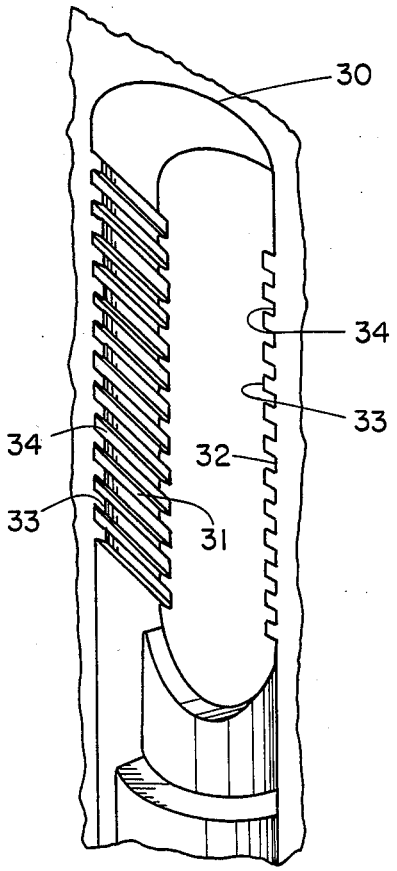
FIG. 4 is a partial view in an expander window.

As shown in FIGS. 2 and 3, the housing means 22 can have a cylindrically formed recess 30 which terminates at a location 31 above the window 25 and at a location 32 below the window 25. The recess 30 provides a fluid bypass area at least equal to the area displaced bythe projecting area of the slips. Thus, the bypass area between the slips can be equal at least to the O.D. of the mandrel member at the bearing means 23 whereas existing designs allow about half this amount due to the area obstruction of the slips. Because slip obstruction can lead to back pressure build up during cementing operations, any improvement in bypass area results in lower cementing pressures and less breakdown of the earth formations.

The value of a 15° angle of inclination on the inclined tongue and grooves of a window and slip element is that the radial force produced by the tangent of the engaged angle is reduced. It has also been discovered that virtually unlimited length of slip can be used which distributes and supports the weight load of a liner and provide greater contact surface for reducing outward radial load per unit area on the casing and reduces the inward radial load per unit area on the mandrel. This results in the frictional drag being cut to less than 10% of the conventional cone-to-slip designs and allows the rotation of substantially longer liner strings. In current slip design multiple expanders and slips are required to support long liners (see U.S. Pat. No. 4,603,743) which raises fluid bypass problems.

OPERATION

For operation, the lower end of tubular mandrel 12 which extends downwardly from the liner hanger 10 is connected to a string of liner pipe. The upper end of the mandrel 12 is releasably connected to a conventional setting nut by a threaded nut (not shown) and the liner, liner hanger and setting tool are lowered into a well bore by a string of pipe or tubing. In going in the well bore, liquid in the well bore is displaced and is in the bore of the liner as well as the annulus about the liner and liner hanger. The outer circumference of the liner hanger 10 is relatively uniform to prevent a blockage or restriction for liquid movement in the annulus between the liner hanger and the well bore. At the desired location of the liner hanger 10, a sealing ball is dropped into the string of pipe and closes off the bore of the string of liner pipe at a location below the hydraulic chamber opening 14. Liquid in the string of pipe above the sealing ball is placed under pressure to move the piston 16 upwardly when the pressure is sufficient to shear the shear pin 17. The piston 16 moves upwardly and moves the attached longitudinal straps 20 and slip elements 21 in an upward direction. The slip elements 21 move upwardly and radially outwardly as dictated by the tongue and grooves 37, 38 in a slot or window 25. After the slip elements 21 engage the casing, the liner is hung by lowering the weight of the liner on the slip elements. The sealing ball is next disabled so that a cement slurry can be pumped through the bore of the liner to cement the annulus. The setting tool can be rotated by the attached string of pipe while the cement slurry is pumped down the string of tubing and through the liner. The cement slurry is displaced into the annulus between the liner and the borehole and displaces the borehole liquid in the annulus. As the cement slurry moves upwardly in the annulus, the borehole liquid is displaced upwardly around the liner hanger. The cylindrical recess 30 in the liner hanger provides an area at least equal to the area displaced by the projecting area of the slip elements so that the cross-sectional slip area does not affect the back pressure on the cement slurry. The rotation of the string of pipe rotates the mandrel 12 and attached liner and is rotatively supported by the bearing 23 above the slip elements. Thus, the rotation of the mandrel 12 is within the tubular housing member 22.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A rotating liner hanger for use in well bores including a tubular liner hanger mandrel adapted for coupling to a liner;

said liner hanger mandrel having an annular outer recess;

a tubular housing member and an annular bearing means rotatively mounted in said annular recess where said bearing means is disposed between said mandrel and the upper end of said housing member and defines an outer diameter portion;

said housing member having circumferentially spaced, elongated openings and having a diameter not to exceed said outer diameter portion;

elongated slip members disposed in said elongated openings in a contracted condition so as to have their outer surfaces located within the outer circumference of said housing member;

said slip members and said openings having inclined tongue and groove interconnections disposed along the side of said slip members and said openings, said tongue and groove interconnections being inclined at an angle of approximately 15° with respect to a longitudinal axis of a slip and opening; and hydraulic means circumferentially arranged on said hanger mandrel so as to not exceed the diameter of said outer diameter portion, said hydraulic means being responsive to fluid pressure within the bore of said hanger mandrel and being attached to said slip members for obtaining relative movement between said housing member and said slip members in response to hydraulic pressure whereby said slip members are movable between a fully retracted position within said housing member and an extended position outwardly of said housing member for engagement with a well casing and so that said mandrel is rotatable relative to said housing member when said slip members are in engagement with a casing wall in an extended position.

2. The hanger as set forth in claim 1 and further including an annular recess in said housing member extending to locations above and below said openings for said slip members for providing a fluid bypass area around said slip elements to offset the cross-sectional area of the slip members in said annular recess.

3. A rotating liner hanger for use in well bores including a tubular liner hanger mandrel adapted for coupling to a liner;

said liner hanger mandrel having an annular outer recess;

a tubular housing member and an annular bearing means rotatively mounted in said annular recess where said bearing means is disposed between said mandrel and the upper end of said housing member and defines an outer diameter portion;

said housing member having circumferentially spaced, elongated openings and having a diameter not to exceed said outer diameter portion;

elongated slip members disposed in said elongated openings in a contracted condition so as to have their outer surfaces located within the outer circumference of said housing member;

said slip members and said openings having inclined tongue and groove interconnections disposed along the side of said slip members and said openings, said tongue and groove interconnections being inclined at an angle of approximately 15° with respect to a longitudinal axis of a slip and opening; and setting means on said hanger mandrel and attached to said slip members for selectively obtaining relative movement between said housing member and said slip members whereby said slip members are movable between a fully retracted position within said housing member and an extended position outwardly of said housing member for engagement with a well casing and so that said mandrel is rotatable relative to said housing member when said slip members are in engagement with a casing wall in an extended position.

4. The hanger as set forth in claim 3 and further including an annular recess in said housing member extending to locations above and below said openings for said slip members for providing a fluid bypass area around said slip members to offset the cross-sectional area of the slip members in said annular recess.

* * * * *